US007956710B2

(12) United States Patent
Minowa et al.

(10) Patent No.: US 7,956,710 B2
(45) Date of Patent: Jun. 7, 2011

(54) ELECTROMAGNETIC RELAY

(75) Inventors: Ryota Minowa, Yamaga (JP); Norio Fukui, Kumamoto (JP); Tetsuya Fujiwara, Kumamoto (JP); Kouji Fujimoto, Yamaga (JP)

(73) Assignee: OMRON Corporation, Kyoto (JP)

( * ) Notice: Subject to any disclaimer, the term of this patent is extended or adjusted under 35 U.S.C. 154(b) by 205 days.

(21) Appl. No.: 12/037,140

(22) Filed: Feb. 26, 2008

(65) Prior Publication Data

US 2008/0231395 A1 Sep. 25, 2008

(30) Foreign Application Priority Data

Mar. 22, 2007 (JP) ..... 2007-074484

(51) Int. Cl.
*H01H 51/22* (2006.01)

(52) U.S. Cl. ..... 335/78; 335/129

(58) Field of Classification Search ..... 335/128–130, 335/78–86

See application file for complete search history.

(56) References Cited

U.S. PATENT DOCUMENTS

| | | | | |
|---|---|---|---|---|
| 5,289,144 | A * | 2/1994 | Liao | 335/78 |
| 5,719,541 | A * | 2/1998 | Mader | 335/78 |
| 6,111,487 | A * | 8/2000 | Hoffmann et al. | 335/78 |
| 6,606,018 | B2 * | 8/2003 | Takano et al. | 335/78 |
| 6,816,044 | B2 * | 11/2004 | Mader et al. | 335/129 |
| 6,903,639 | B2 * | 6/2005 | Sanada et al. | 335/129 |
| 6,940,375 | B2 * | 9/2005 | Sanada et al. | 335/86 |
| 7,477,119 | B2 * | 1/2009 | Wu | 335/83 |
| 2002/0024412 | A1 * | 2/2002 | Wu | 335/129 |
| 2002/0130741 | A1 | 9/2002 | Noguchi | |
| 2004/0246080 | A1 * | 12/2004 | Tanaka et al. | 335/128 |

FOREIGN PATENT DOCUMENTS

JP 2004-139750 5/2004

OTHER PUBLICATIONS

Partial European Search Report issued in European Application No. EP 08 15 0465 mailed on Aug. 6, 2008, 6 pages.

English language abstract of Publication No. JP2004139750 dated May 13, 2004 from esp@cenet, 1 page.

* cited by examiner

*Primary Examiner* — Elvin G Enad
*Assistant Examiner* — Bernard Rojas
(74) *Attorney, Agent, or Firm* — Osha • Liang LLP

(57) ABSTRACT

An electromagnetic relay is structured such that a base includes a movable contact piece and a fixed contact piece. A movable contact point included in the movable contact piece is connected to and disconnected from a fixed contact point included in the fixed contact piece by operating the movable contact piece via a card. At least any one of the base and the card includes a guide portion for guiding the card in a freely reciprocating manner with respect to the base. The card includes a guide protruding portion and a pressing portion for pressing the movable contact piece to elastically deform the movable contact piece. The movable contact piece includes a guide portion in a side portion of the movable contact point. The guide portion includes a guide hole into which the guide protruding portion is inserted, a pressure receiving portion positioned at an opposite side to the movable contact point with respect to the guide hole and pressed by the pressing portion, and a reinforcing portion for preventing plastic deformation at a time of being pressed by the pressing portion. The guide hole maintains a non-contact state of the card during the reciprocating motion.

5 Claims, 12 Drawing Sheets

ELECTROMAGNETIC RELAY

BACKGROUND OF THE INVENTION

1. Field of the Invention

The present invention relates to an electromagnetic relay.

2. Description of the Related Art

Conventionally, there has been known an electromagnetic relay in which a contact point is opened and closed by exciting an electromagnet block to rotate a movable iron piece and driving a movable contact piece via a card (for example, refer to Japanese Patent Application Laid-Open No. 2004-139750). The electromagnetic relay is provided with various reinforcing structures for securing the strength of the movable contact piece which is pressed by the card.

However, the conventional electromagnetic relay is structured such that a protruding portion formed in the card is inserted into a guide hole formed in the movable contact piece, and the movable contact piece is driven by pressing an edge portion of the guide hole. Further, the card is made of a resin material. Accordingly, the protruding portion comes into slidable contact with an inner edge of the guide hole every time the card reciprocates, and generates a resin powder. This generates a problem that the resin powder attaches to a surface of the contact point and causes malfunction.

SUMMARY OF THE INVENTION

One or more embodiments of the present invention provide an electromagnetic relay capable of suppressing generation of resin powder from a card and maintaining a good operating characteristic over a long period of time.

In accordance with one or more embodiments of the present invention, an electromagnetic relay is structured such that a base includes a movable contact piece and a fixed contact piece, and a movable contact point included in the movable contact piece is connected to and disconnected from a fixed contact point included in the fixed contact piece by operating the movable contact piece via a card, wherein at least any one of the base and the card includes a guide portion for guiding the card so as to freely reciprocate with respect to the base, and the card includes: a guide protruding portion; and a pressing portion for pressing the movable contact piece to elastically deform the movable contact piece, the movable contact piece including a guide portion in a side portion of the movable contact point, the guide portion including: a guide hole into which the guide protruding portion is inserted and which maintains a non-contact state during reciprocating motion of the card; a pressure receiving portion positioned at an opposite side to the movable contact point with respect to the guide hole and pressed by the pressing portion; and a reinforcing portion for preventing plastic deformation at the time of being pressed by the pressing portion.

With this structure, the guide protruding portion does not come into contact with the movable contact piece. Accordingly, the guide protruding portion does not generate the resin powder caused by the slidable contact. Further, the pressing portion is structured in such a manner as to press the pressure receiving portion positioned at the opposite side to the movable contact point with respect to the guide hole. Accordingly, even if the resin powder is generated from the pressing portion, the distance to the contact point is sufficiently long, and the guide protruding portion is interposed between the pressing portion and the contact point, so that the resin powder is not attached to the contact point. In addition, since the plastic deformation is prevented by the reinforcing portion, it is possible to maintain desired contact point contact pressure for a long term, and it is possible to achieve a good contact point opening and closing operation.

The movable contact piece may be caulked and fixed in the movable contact point, and the reinforcing portion may be formed on an edge portion at a position remotest from the base up to at least the caulked and fixed position in the guide portion.

With this structure, although the pressure receiving portion of the movable contact piece corresponding to the pressing position by the pressing portion of the card corresponds to the position which is remotest from the movable contact point, it is possible to achieve a good contact point opening and closing operation by providing reinforcement up to the caulked and fixed position having high rigidity by the reinforcing portion.

The pressing portion of the card is formed in such a manner as to bulge as heading toward the center, and the position for pressing the pressure receiving portion of the movable contact piece is at an opposite side to the movable contact point with respect to the guide protruding portion.

With this structure, it is possible to press the pressure receiving portion of the movable contact piece with the pressing portion of the card in point contact or line contact. Accordingly, it is possible to set the pressing position as designed, and it is possible to achieve a good contact point opening and closing operation while stabilizing the pressing state. Further, since the pressing portion is formed in such a manner as to bulge gradually toward the center, it is possible to press the pressure receiving portion of the movable contact piece, which elastically deforms to change the tilting degree with respect to the pressing portion, in a suitable state at all times.

In accordance with one or more embodiments of the present invention, the guide protruding portion formed in the card does not come into contact with the edge portion of the guide hole formed in the movable contact piece and the resin powder is not generated when opening and closing the contact point. Accordingly, it is possible to prevent the resin powder from attaching to the surface of the contact point and causing cause malfunction. Further, the position for pressing the movable contact piece is in the opposite side to the movable contact point with respect to the guide hole. Further, the guide protruding portion is positioned between both the components. Accordingly, even if the resin powder is generated from the pressing portion, it is possible to inhibit the resin powder from being attached to the contact point by the guide protruding portion. Further, though the pressing position is set at the position which is remotest from the contact point, it is possible to achieve a good contact point opening and closing operation by the function of the reinforcing portion.

BRIEF DESCRIPTION OF THE DRAWINGS

FIG. 2B shows a perspective view of a state in which FIG. 2A is viewed from a different angle;

DETAILED DESCRIPTION OF THE EMBODIMENTS

Figure 1:
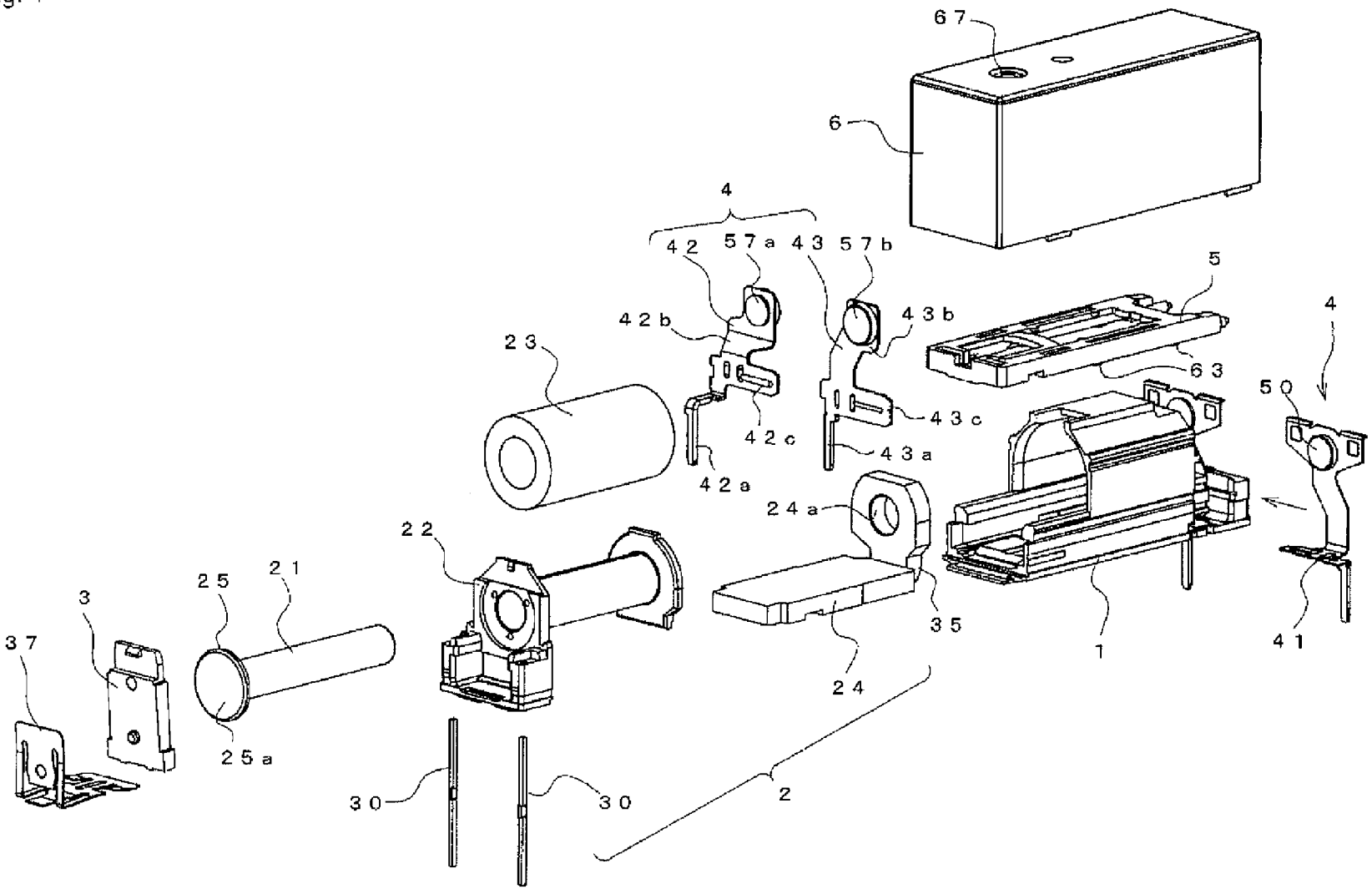
FIG. 1 shows an exploded perspective view of an electromagnetic relay in accordance with an embodiment of the present invention.

A description will be given below on embodiments in accordance with the present invention with reference to the accompanying drawings. It should be noted that terms expressing directions, positions, and the like (for example, "upper", "lower", "edge", "side" and other terms including these terms) are appropriately used in the specification of the present invention, but these terms only indicate directions, positions, and the like in the drawings used for the description, and the present invention should not be narrowly construed by these terms.

(Structure)

Figure 2A:
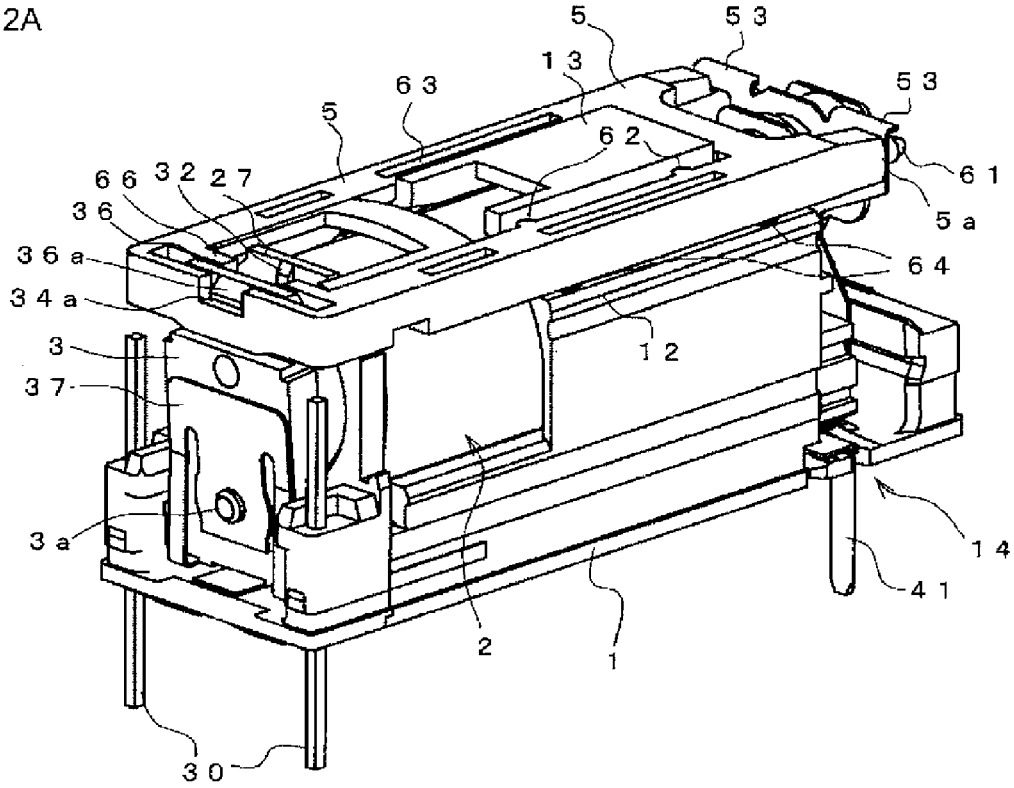
FIG. 2A shows a perspective view of a state in which a case of the electromagnetic relay in accordance with the embodiment is removed.
Figure 2B:
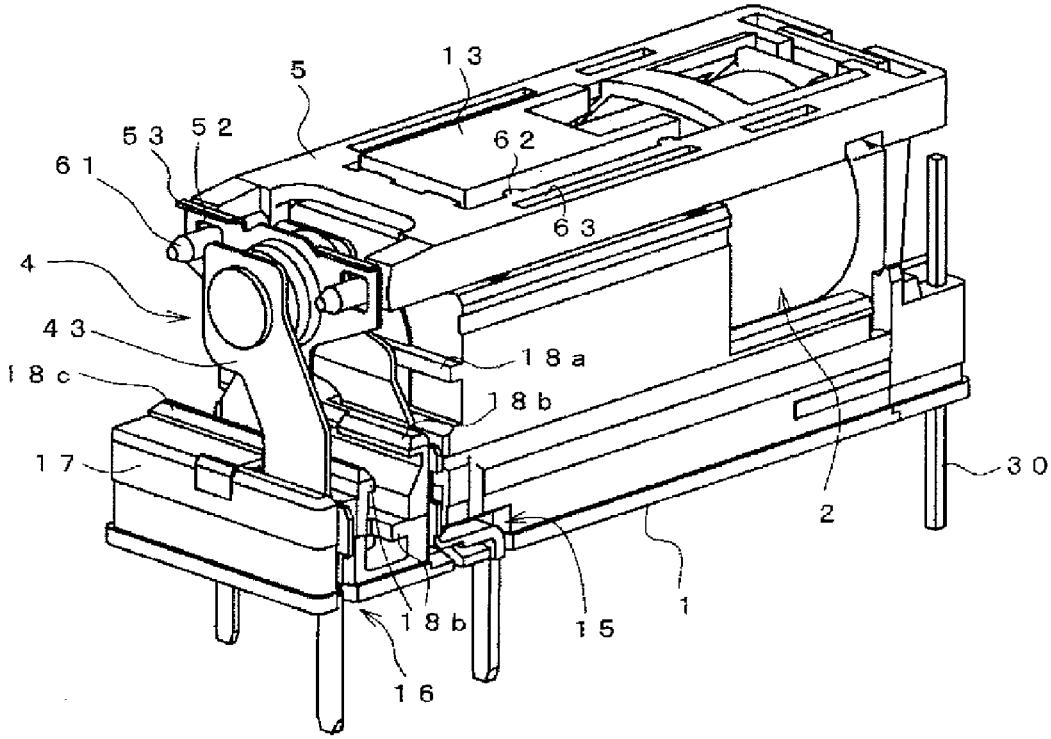
Figure 3:
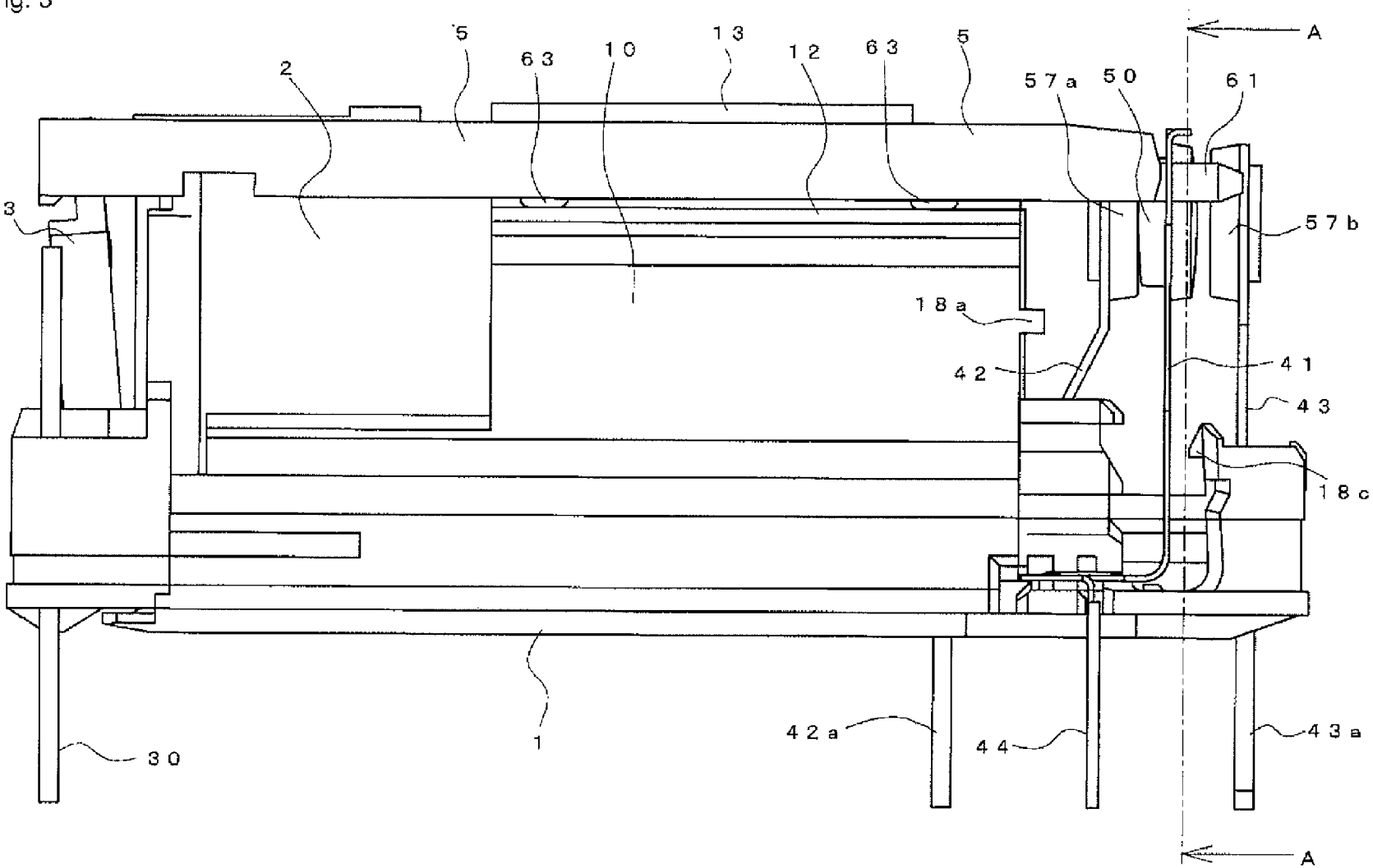
FIG. 3 shows a front view of a state in which the case of the electromagnetic relay in accordance with the embodiment is removed.
Figure 4:
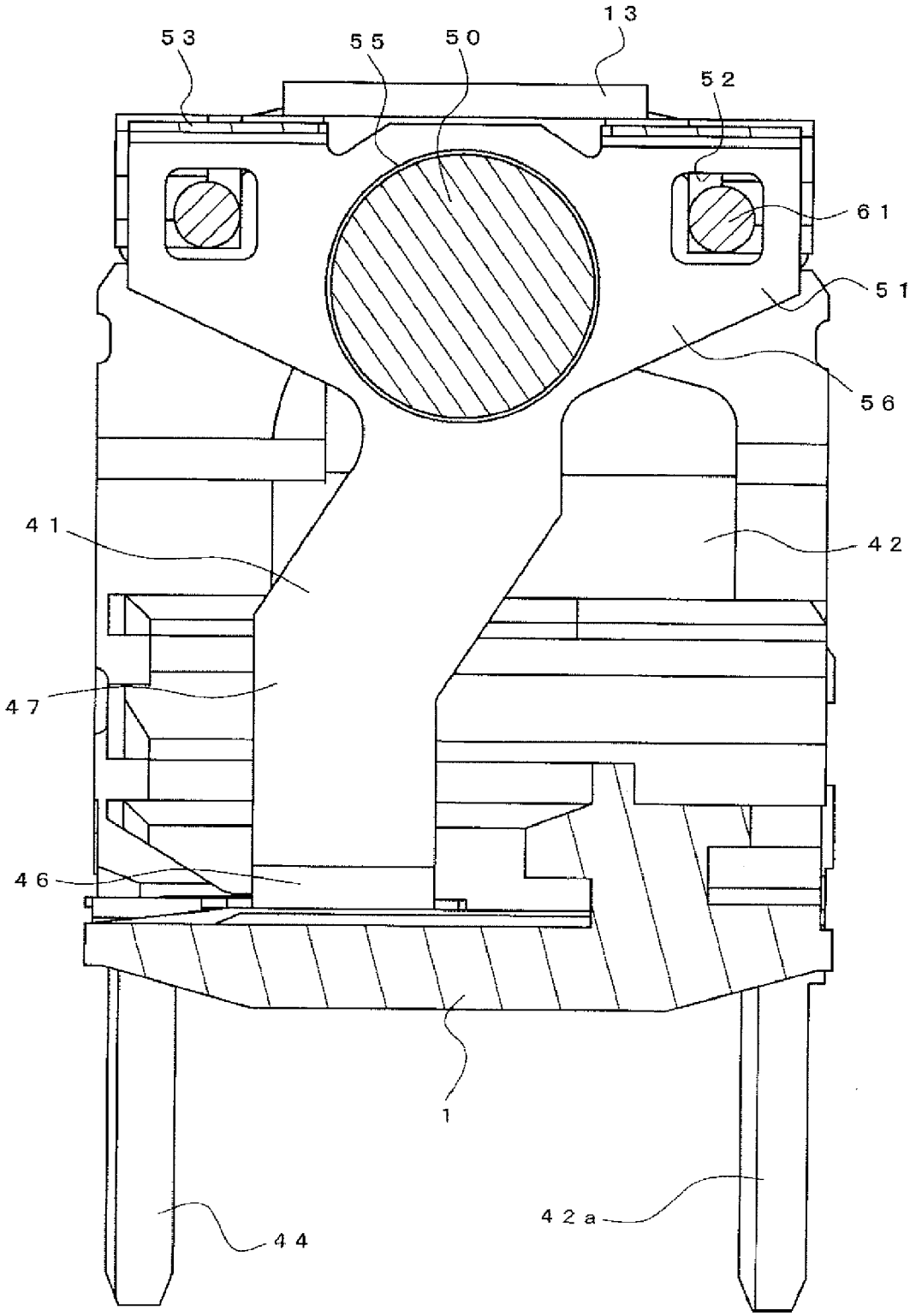
FIG. 4 shows a cross-sectional view taken along the line A-A in FIG. 3.

FIGS. 1 to 3 show an electromagnetic relay in accordance with one or more embodiments of the present invention. The electromagnetic relay is generally structured such that a base 1 is provided with an electromagnet block 2, a movable iron piece 3, a contact point opening and closing mechanism portion 4, and a card 5, a case 6 is put thereon, and the internal portion is thereafter sealed by a sealing agent injected into a fitted portion or the like.

The base 1 includes, as shown in FIG. 7, a first retaining portion 7 in which the electromagnet block 2 is retained, and a second retaining portion 8 in which the contact point opening and closing mechanism portion 4 is retained, and is obtained by molding a synthetic resin material.

Figure 7A:
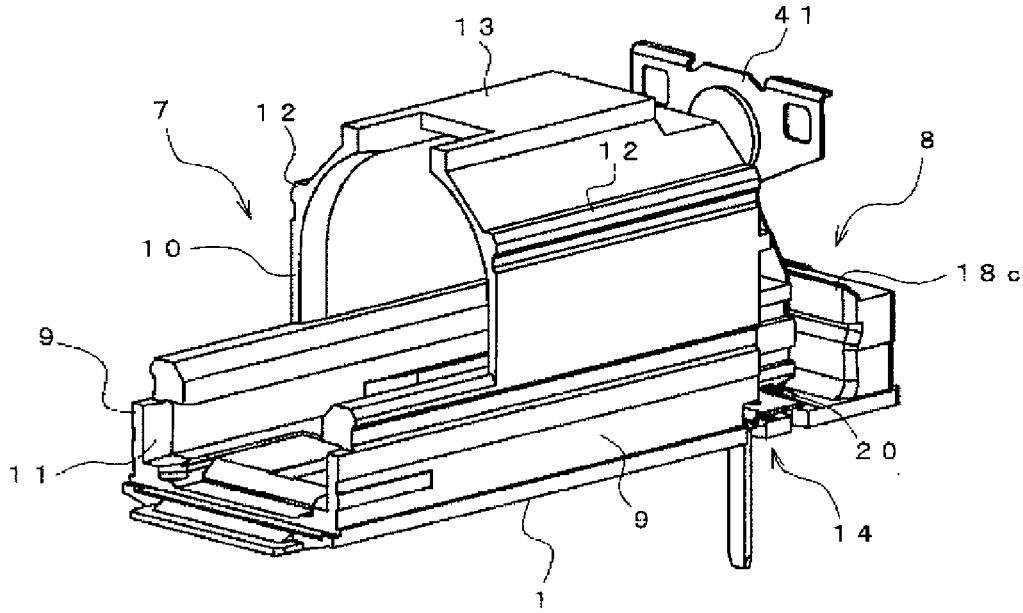
FIG. 7A shows a perspective view of a base.

The first retaining portion 7 includes, as shown in FIG. 7A, a side wall portion 9, and a housing portion 10 covering an upper side of an approximately half region of the side wall portion 9 and being opened to one end side. An upper end of the side wall portion 9 extends to an inner side, and constructs a guide portion 11 having an approximately C-shaped cross section as a whole. The housing portion 10 is provided for securing a predetermined insulating property (a creepage distance) between the electromagnet block 2 and the contact point opening and closing mechanism portion 4. A guide protruding portion 12 extending in a longitudinal direction is formed in each of both side surfaces of the housing portion 10. The guide protruding portion 12 supports the reciprocating card 5. Further, a rectangular protruding portion 13 having a rectangular shape in a plan view and positioned within an opening portion of the card 5 for guiding is formed on an upper surface of the housing portion 10.

Figure 5:
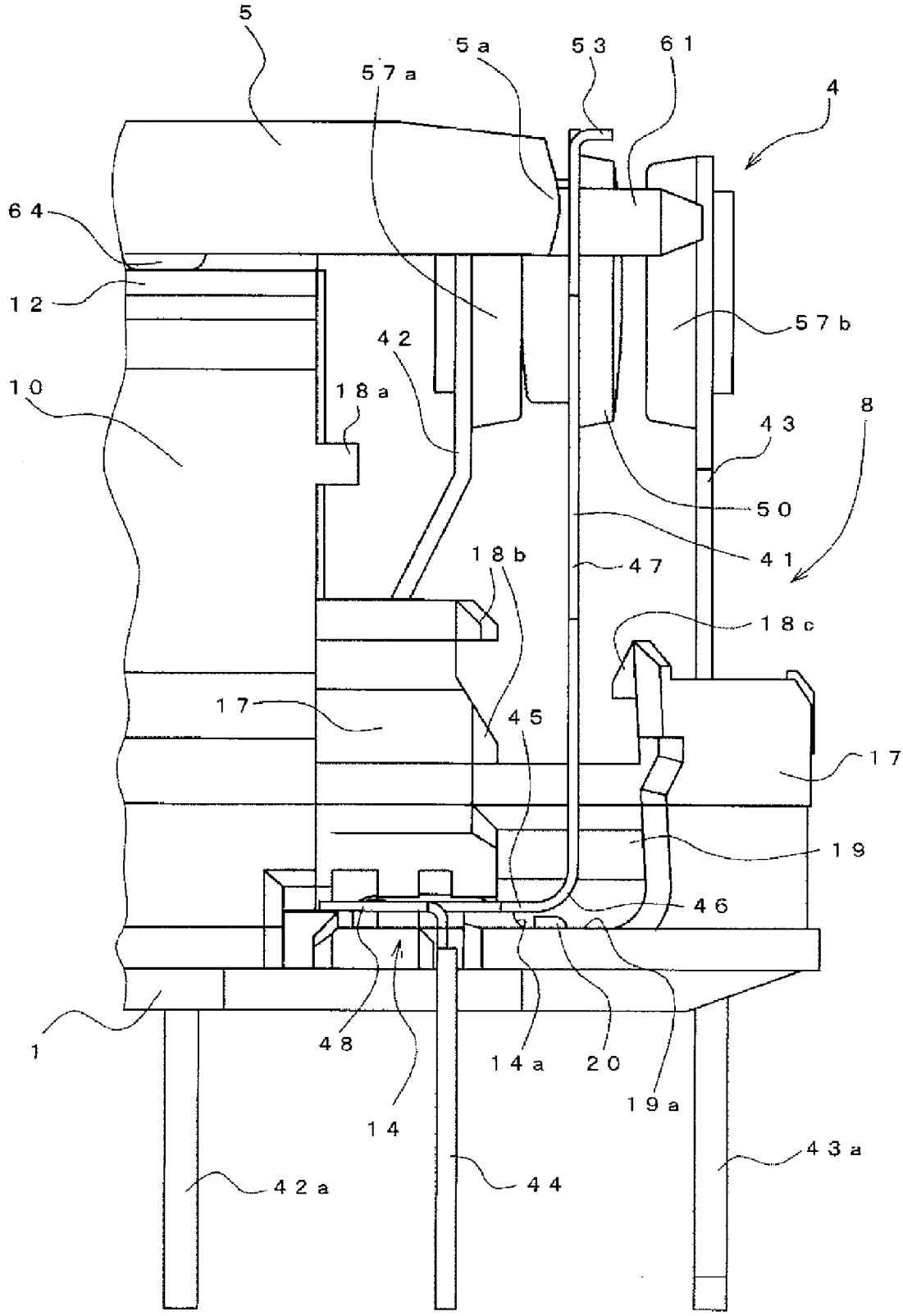
FIG. 5 shows a partially enlarged view of FIG. 3.
Figure 6A:
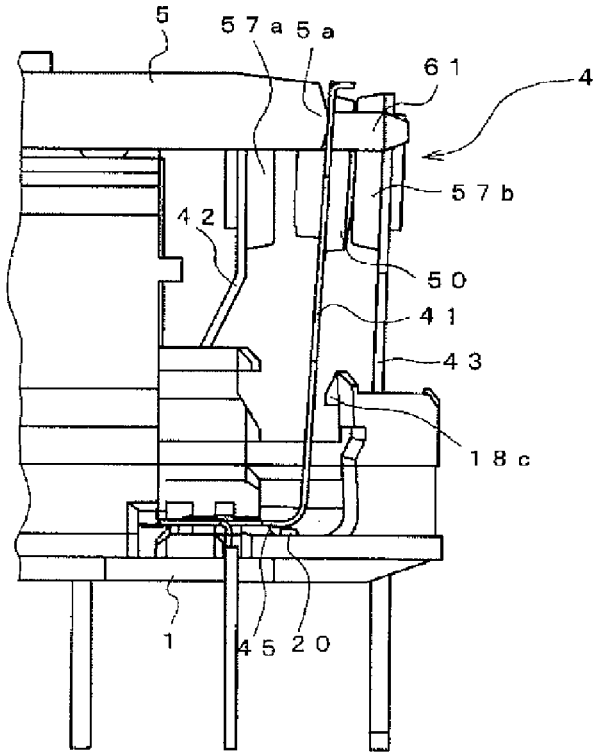
FIG. 6A shows a diagram of a state in which an electromagnet block is excited from a state shown in FIG. 5 and a movable contact point is closed to a second fixed contact point.
Figure 6B:
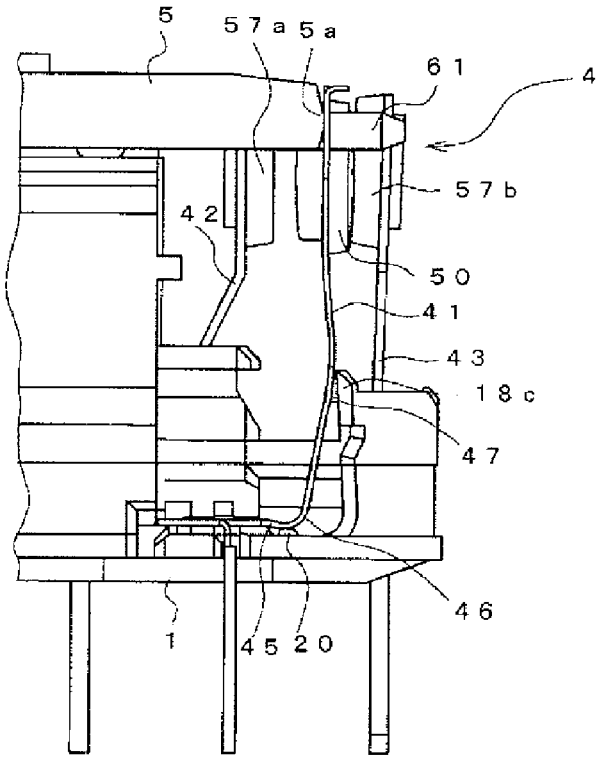
FIG. 6B shows a diagram of a deformed state of a movable contact piece in the case where impact force is applied.
Figure 7B:
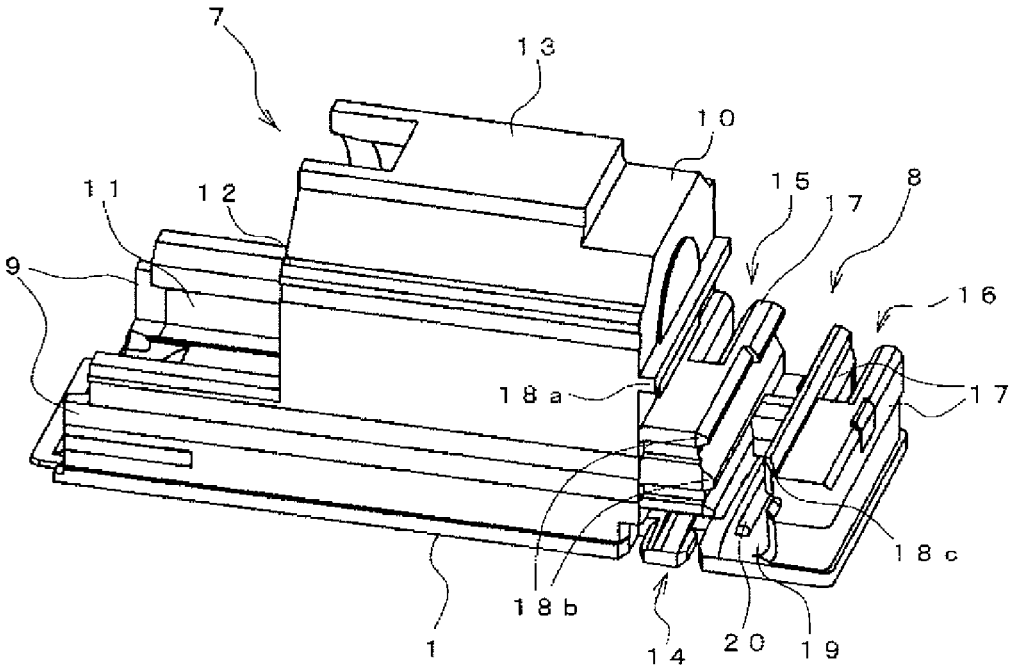
FIG. 7B shows a perspective view of a state in which the base is viewed from a different angle from FIG. 7A.

The second retaining portion 8 is structured, as shown in FIGS. 5 and 7B, such that a first press fitting receiving portion 14 in which a movable contact piece 41 is press fitted, a second press fitting receiving portion 15, and a third press fitting receiving portion 16 in which a first fixed contact piece 42 and a second fixed contact piece 43 are press fitted respectively, are formed in both side portions at one end side of the base 1. Each of portions between the press fining receiving portions 14, 15, and 16 is comparted by each of rising insulating walls 17, and is structured such that a desired insulating property can be secured between the contact pieces 41, 42, and 43. A plurality of protruding portions 18*a* and 18*b* is formed on an end surface of the housing portion 10 and the insulating wall 17 respectively. The protruding portion 18*a* formed in the end surface of the housing portion 10 is formed along the entire width direction and has a rectangular cross sectional shape. Further, a lower surface of the protruding portion 18*a* is formed as a region (a non-attached region) to which carbon generated and flying in all directions when opening and closing the contact point cannot be attached. Accordingly, it is possible to reliably prevent conduction with the movable contact piece 41 through the carbon attached to a surface of the base 1 from the first fixed contact piece 42. Further, the protruding portion 18*b* formed in the upper end portion and the side surface of each of the insulating walls 17 also forms a non-attached region for the carbon. According to one or more embodiments of the present, the protruding portions 18*b* and 18*c* are formed to have a triangular cross sectional shape in which an upper surface is inclined. As described above, on the basis of the structure provided with the protruding portions 18*a*, 18*b* and 18*c*, it is possible to prevent occurrence of a problem that the portions between the contact pieces 41, 42, and 43 are conducted (short) by the carbon. Further, the protruding portion 18*c* not only forms the non-attached region for the carbon, but also provides a deformation preventing function for preventing plastic deformation of the movable contact piece 41, or more specifically, a second contact piece portion 47 in the case where impact force is applied. The shapes of the protruding portions 18*a*, 18*b* and 18*c* are not limited to those mentioned above, but can employ various forms as far as they can form the non-attached region for the carbon flying in all directions.

A concave portion 19 surrounded by the insulating walls 17 is formed in a side portion of the first press fitting receiving portion 14, as shown in FIG. 5. A protruding position of the movable contact piece 41 press fitted in the first press fitting receiving portion 14, that is, a position of a first contact piece portion 45, is separated from a bottom surface of the concave portion 19 by a predetermined distance. A side surface to which the first contact piece portion 45 protrudes in the portions constructing the first press fitting receiving portion 14 is structured such that a lower side thereof forms a concave circular arc surface 14*a*. Accordingly, it is possible to prevent the sealing agent flowing from the bottom surface of the base 1 along a terminal portion 44 from making further intrusion by the circular arc surface 14*a*. Further, a deformation preventing portion 20 is formed on the bottom surface of the concave portion 19 at a predetermined distance from along the circular arc surface 14*a*. The deformation preventing portion 20 is formed on an inner side at a predetermined distance from a side edge portion of the base 1. Accordingly, it is possible to prevent the resin that has entered from an edge portion of the base 1 from reaching the deformation preventing portion 20, particularly a surface with which the deformed movable contact piece 41 can be brought into contact.

The electromagnet block 2 is structured, as shown in FIGS. 1 and 8, such that a coil 23 is wound around an iron core 21 via a spool 22, and a yoke 24 is caulked and fixed.

The iron core 21 is structured, as shown in FIG. 1, such that a magnetic material is formed into a columnar shape, and a collar-shaped magnetic pole portion 25 is formed at one end side. An end surface of the magnetic pole portion 25 corresponds to a magnetic pole surface 25*a*. The other end portion (an end portion in the opposite side to the magnetic pole portion 25) of the iron core 21 is structured so as to be caulked and fixed to the yoke 24.

Figure 9:
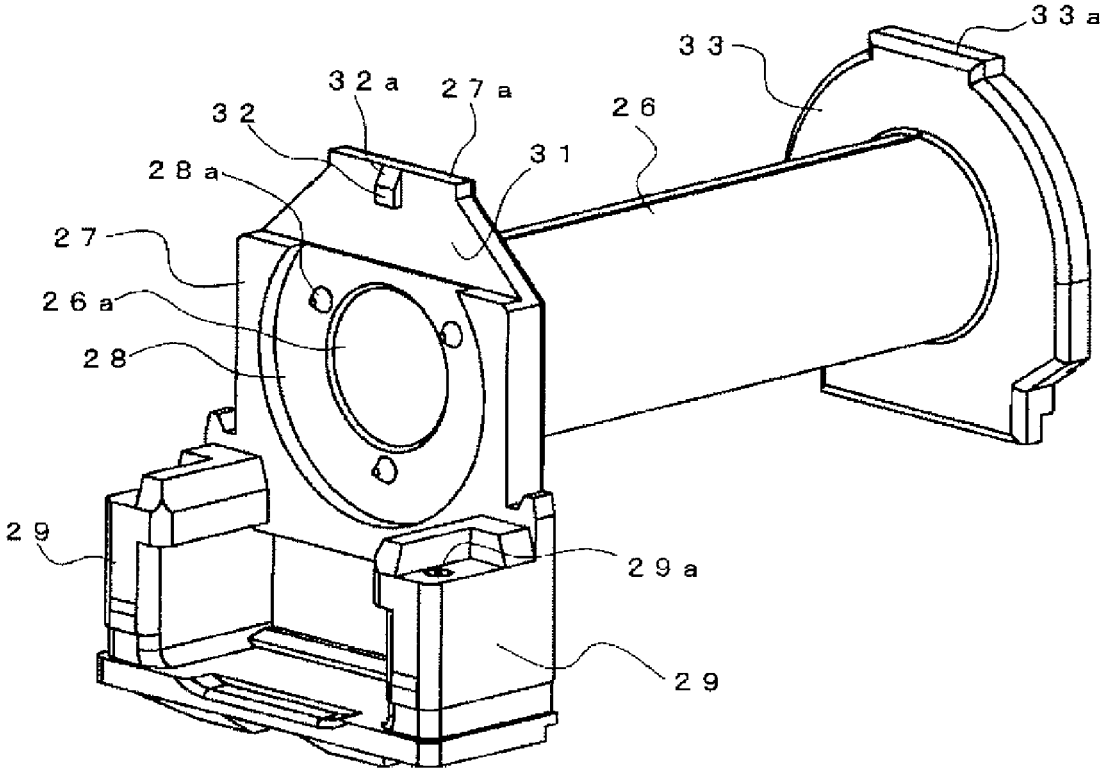
FIG. 9 shows a perspective view of a spool of the electromagnet block.

The spool 22 is structured, as shown in FIG. 9, such that collar portions 27 and 33 are respectively formed at both ends of a cylindrical trunk portion 26, and is obtained by molding a synthetic resin material. A circular concave portion 28 in which the magnetic pole portion 25 of the iron core 21 is arranged is formed on an end surface of one collar portion (the first collar portion 27), and a center hole 26*a* of the trunk portion 26 is opened in a central portion thereof. The circular concave portion 28 is provided with a plurality of projections 28*a* that contact the magnetic pole portion 25 to be crushed, around the center hole 26*a* (according to one or more embodiments of the present invention, the projections 28*a* are approximately formed in a triangular pyramid shape in which a cross sectional area becomes smaller gradually in a protruding direction, and are provided uniformly at three positions around the center hole). A seat portion 29 is formed at each of both sides under the first collar portion 27. A terminal hole 29*a* is formed in each of the seat portions 29, and is structured such that a coil terminal 30 is each press fitted and fixed thereto. A step portion 31 is formed at the same side as the circular concave portion 28, in an upper portion of the first collar portion 27. The step portion 31 is provided for avoiding interference with the card 5 and expanding the moving range of the card 5 when the card 5 reciprocates. Further, the width of an upper portion of the first collar portion 27 becomes gradually narrower toward the upper side, and an upper end portion thereof forms a protruding portion 27*a* having a predetermined width. Further, an insertion preventing protruding portion 32 is formed in the protruding portion 27*a*, on an end surface side in which the step portion 31 is formed. The insertion preventing protruding portion 32 prevents a thickness gauge 68 utilized in an adjusting work after the assembly from being inserted into an unnecessary portion. Further, an upper surface of the insertion preventing protruding portion 32 is constructed with an inclined surface 32*a*, and also plays a role of smoothly guiding the thickness gauge 68 to a predetermined position (between the movable iron piece 3 and the magnetic pole portion 25 of the iron core 21). On the other hand, a protruding portion 33*a* similar to the first collar portion 27 is formed in an upper end portion of the other collar portion (the second collar portion 33).

Figure 10A:
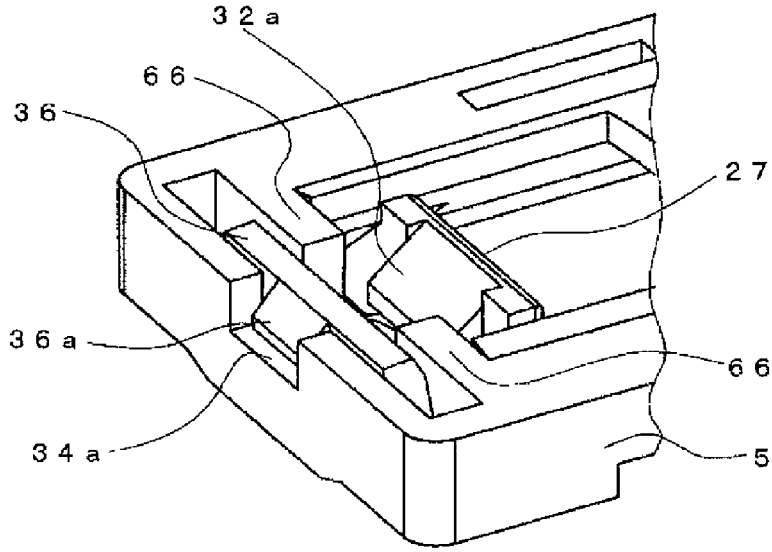
FIGS. 10A to 10C show partial perspective views including an insertion preventing protruding portion of a spool in accordance with another embodiment.
Figure 10B:
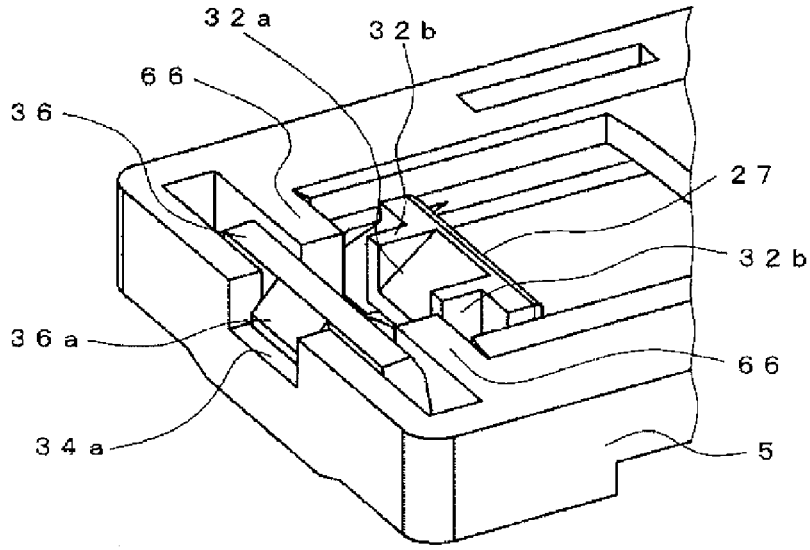
Figure 10C:
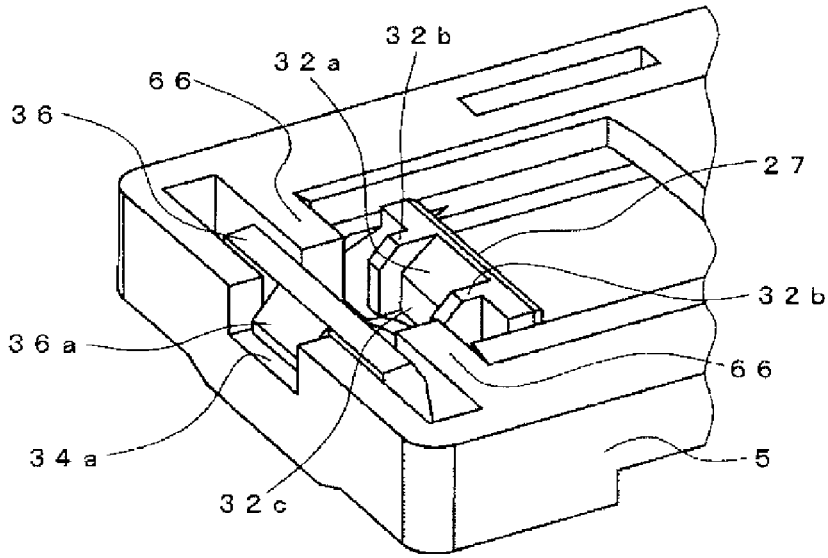

Incidentally, the insertion preventing protruding portion 32 can also be structured as shown in FIGS. 10A to 10C. In FIG. 10A, an occupied area of the inclined surface 32*a* is enlarged to a width side and a lower side. In FIG. 10B, guide walls 32*b* are formed at both sides. In FIG. 10C, the inclined surface 32*a* is interrupted, and the guide walls 32*b* are positioned at both sides of a vertical wall 32*c* extending from the inclined surface 32*a*. With these structures, particularly with the structure including the guide walls 32*b*, it is possible to further prevent the thickness gauge 68 from being inserted into an unnecessary position and to easily guide the thickness gauge 68 to a proper position. According to one or more embodiments of the present invention, if the guide walls 32*b* are expanded in such a manner that upper portions thereof gradually separate from each other, it is possible to more easily insert the thickness gauge 68.

The coil 23 is structured such that it is protected with an insulating film around a copper wire, and is wound around the trunk portion 26 of the spool 22. The copper wires at both end portions thereof are wound around the coil terminals 30 and soldered (which is drawn in a wound state in FIG. 1, but is actually wound around the trunk portion 26 of the spool 22 by an automatic machine).

The yoke 24 is formed into an approximately L-shape by press working a plate member made of a magnetic material, as shown in FIG. 1. Locking concave portions 34 (refer to FIG. 8B) to lock a hinge spring 37 at both sides of the yoke 24 are formed on one surface on one end side of the yoke 24. Further, the other end side of the yoke 24 extends vertically via a narrow neck portion 35 for easy bending, and a through hole 24*a* for caulking and fixing an end portion of the iron core 21 is formed therein.

Figure 8A:
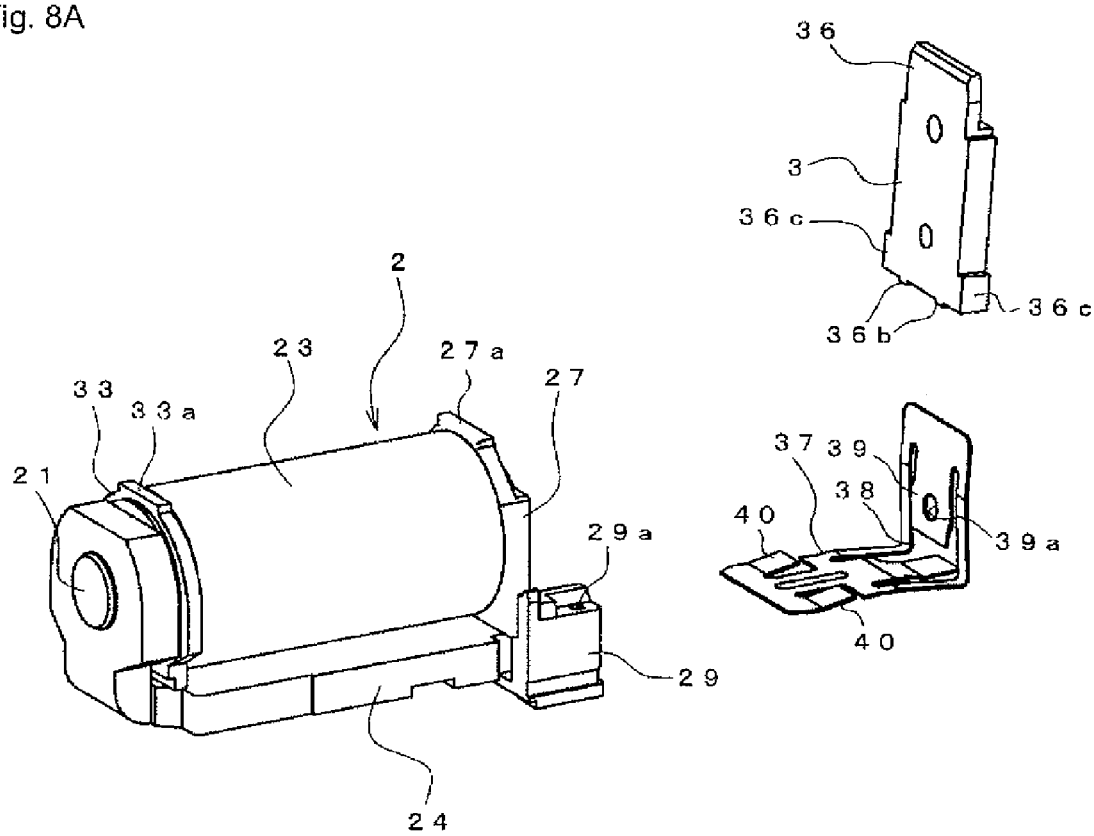
FIG. 8A shows an exploded perspective view of a state in which a movable iron piece and a hinge spring of the electromagnet block are separated.
Figure 8B:
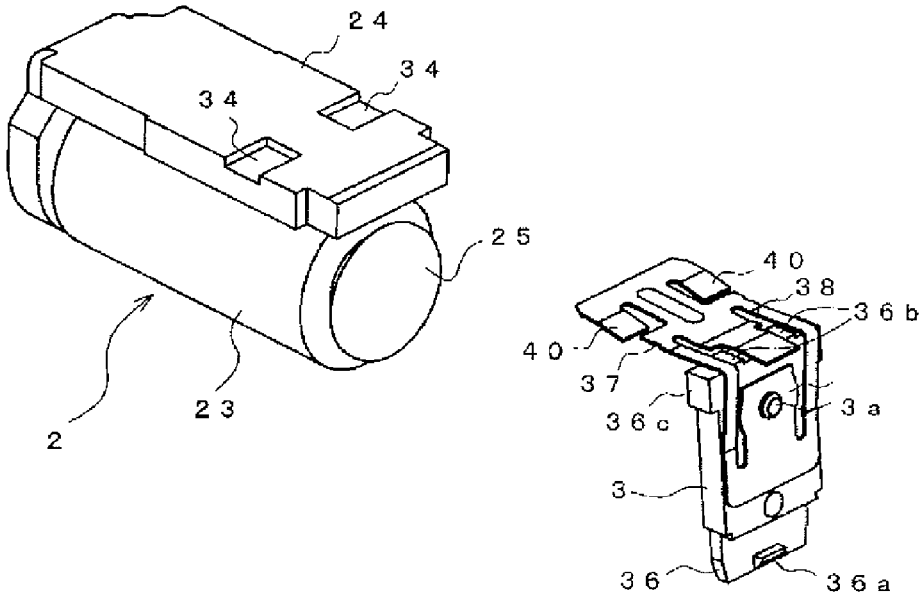
FIG. 8B shows an exploded perspective view as seen from an opposite side and showing a state in which the movable iron piece and the hinge spring are integrally separated.

The movable iron piece 3 has a plate shape formed by press working a magnetic material. As shown in FIGS. 8A and 8B, an upper end portion of the movable iron piece 3 is smaller in thickness and width to form a coupling portion 36, and a locking pawl 36*a* is formed thereon. Further, projections 36*b* and 36*c* are formed on an end surface and at both sides respectively, in a lower end portion of the movable iron piece 3. The projections 36*b* on the end surface are positioned in a notch 38 of the hinge spring 37, and prevent displacement. The projections 36*b* and 36*c* on both sides become a center of rotation. Further, a caulking and fixing projection 3*a* for attaching the hinge spring 37 is formed on a center portion of one surface of the movable iron piece 3.

The hinge spring 37 is obtained by bending a plate member made of a thin spring material through press working so as to be formed in an approximately L-shape, as shown in FIGS. 8A and 8B. An approximately H-shaped notch 38 is formed in the bent portion and is structured such that a sufficient spring property can be obtained. A tongue piece 39 is formed by the notch 38 in one end portion of the hinge spring 37, and a through hole 39*a*, into which the projection 3*a* of the movable iron piece 3 is inserted to be caulked and fixed, is formed in the tongue piece 39. Further, elastic locking portions 40 protrude from both the sides on the other end portion of the hinge spring 37 and are locked to a locking concave portions 34 formed in the yoke 24, whereby the hinge spring 37 can be fitted to the electromagnet block 2 together with the movable iron piece 3.

The contact point opening and closing mechanism portion 4 is constituted by a movable contact piece 41, a first fixed contact piece 42, and a second fixed contact piece 43, as shown in FIG. 1, which can be obtained by press working a conductive plate member.

Figure 11A:
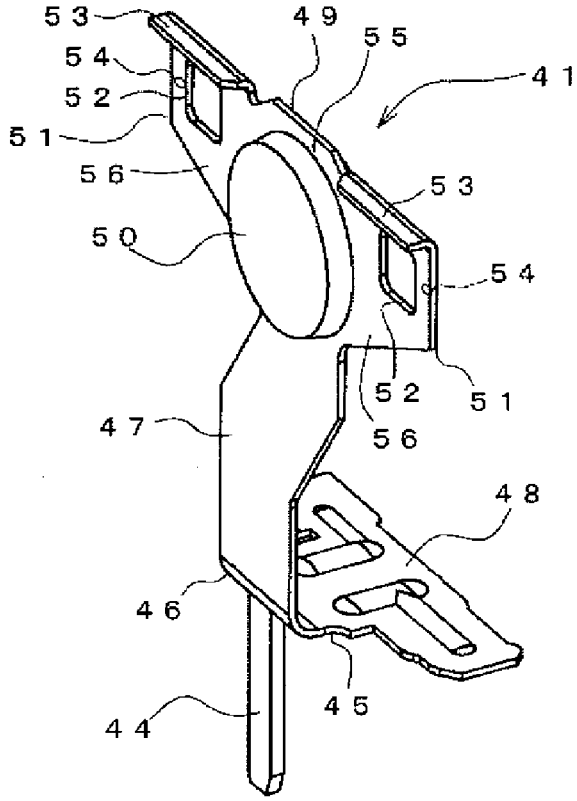
FIG. 11A shows an enlarged perspective view of the movable contact piece shown in FIG. 1.

The movable contact piece 41 is constituted by a terminal portion 44, the first contact piece portion 45, a bent portion 46, and the second contact piece portion 47, as shown in FIGS. 5 and 11A. The terminal portion 44 protrudes from the bottom surface of the base 1, and includes a press fitting portion 48 to be press fitted in the first press fitting receiving portion 14 of the base 1. The first contact piece portion 45 protrudes to a side portion from the terminal portion 44, and is at a position which is away from the bottom surface 19*a* of the concave portion 19 at a predetermined distance in a state in which the terminal portion 44 is press fitted in the first press fitting receiving portion 14 of the base 1. The bent portion 46 changes its direction gradually from the first contact piece portion 45 protruding approximately in parallel to the bottom surface 19*a* of the concave portion 19 to a direction which is orthogonal to the bottom surface 19*a*. The second contact piece portion 47 continues from the bent portion 46 and extends in a direction which is orthogonal to the bottom surface 19*a*. A middle portion of the second contact piece portion 47 is bent in the width direction, and forms a contact point attaching portion 49 which gradually becomes wider so that an upper portion is wide. A through hole 49*a* to which a movable contact point 50 is caulked and fixed is formed in the contact point attaching portion 49, and guide holes 52 and reinforcing portions 53 are formed in extended portions 51 at both sides of the contact point attaching portion 49. The guide hole 52 is formed into a rectangular shape, and a guide shaft portion 61 of the card 5 is arranged in a non-contact manner. A side edge portion constructing each of the guide hole 52, or more specifically, a position in the opposite side to the movable contact point 50, forms a pressure receiving portion 54 to be pressed by the pressing portion 5*a* of the card 5. The reinforcing portions 53 are formed by bending an upper edge portion of the contact point attaching portion 49 approximately in a perpendicular direction, and the range thereof reaches a caulked region 55 from the side edge portion. According to one or more embodiments of the present invention, the caulked region 55 means a region in which the movable contact point 50 is caulked and fixed to attain increased rigidity. Further, lower portions of the extended portions 51 are provided with approximately triangular reinforcing regions 56 in which the width becomes narrower gradually.

Figure 11B:
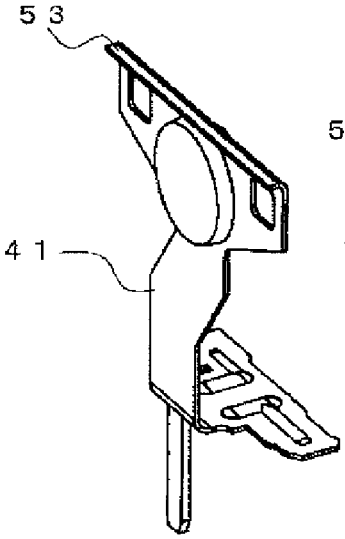
FIGS. 11B to 11D show perspective views of a movable contact piece in accordance with other embodiments.
Figure 11C:
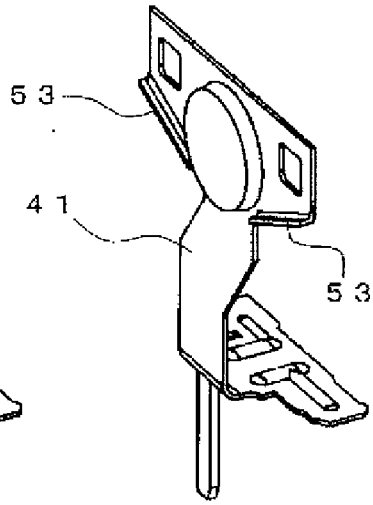
Figure 11D:
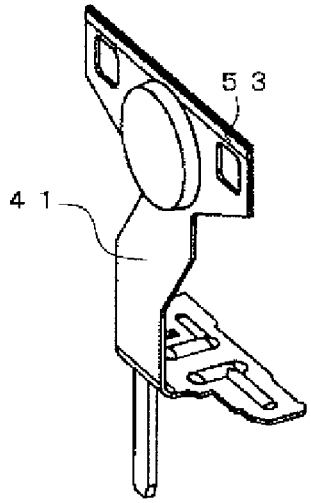

The reinforcing portion 53 of the movable contact piece 41 can be structured, for example, as shown in FIGS. 11B to 11D. FIG. 11B shows the reinforcing portion 53 formed by bending the entire upper edge portion of the movable contact piece 41 approximately in a perpendicular direction. FIG. 11C shows the reinforcing portions 53 formed by bending lower side inclined edges of the reinforcing regions 56 approximately at a right angle. FIG. 11D shows the reinforcing portion 53 constituted by a rib formed by protruding a portion lower at a predetermined distance from the upper edge of the movable contact piece 41 in a width direction. Any of the structures allows the contact point to be opened and closed with a good response property even in the case of pressing the pressure receiving portions 54 at the both side portions, by forming the reinforcing portion 53 in a range up to the caulked region 55 where the movable contact point 50 is caulked, from both the side edge portions of the extended portions 51.

According to one or more embodiments of the present invention, the first fixed contact piece 42 and the second fixed contact piece 43 include terminal portions 42*a* and 43*a*, and contact piece portions 42*b* and 43*b* to be provided with the first and second fixed contact points 57*a* and 57*b*. Press fitting portions 42*c* and 43*c* are formed in the middle of the contact piece portions 42*b* and 43*b*.

Figure 12:
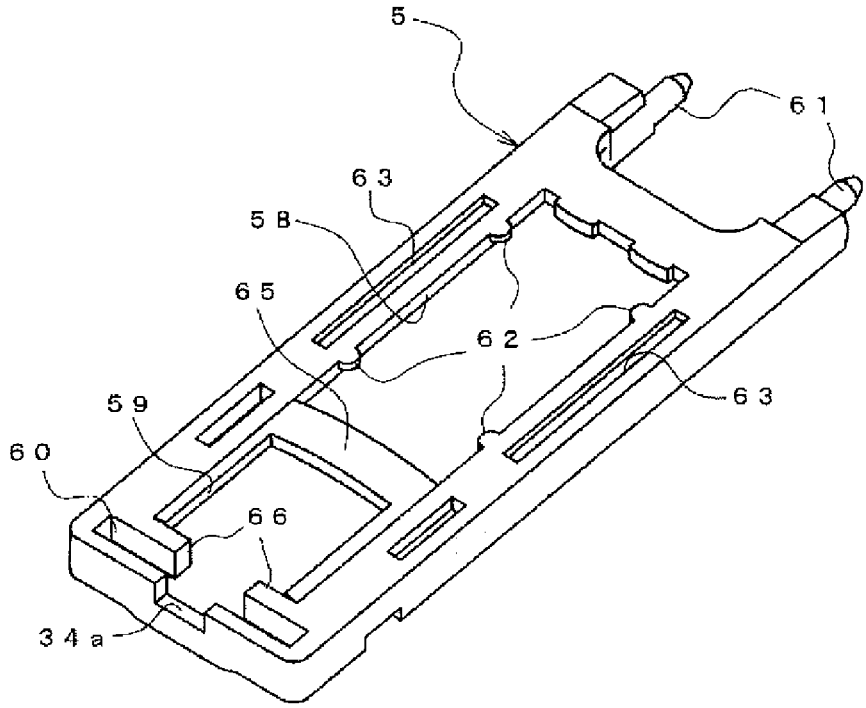
FIG. 12 shows an enlarged perspective view of a card shown in FIG. 1.

The card 5 is formed by molding a synthetic resin material and includes a first opening portion 58 in which the rectangular protruding portion 13 of the base 1 is arranged, a second opening portion 59 forming a runout portion, and a guide portion 60 formed in part of the second opening portion 59, as shown in FIGS. 1 and 12.

Guide shaft portions 61 protruding in a longitudinal direction are formed at both sides on one end side outer edge portion constructing the first opening portion 58. Each of the guide shaft portions 61 is positioned within the guide hole 52 of the movable contact piece 41, and does not contact the movable contact piece 41 at all while the card 5 is reciprocated. However, when impact force is applied and the movable contact piece 41 is deformed, the guide shaft portions 61 contact inner edges of the guide holes 52 so as to prevent further deformation. Further, first guide projections 62 protruding to the inner side are formed at two positions respectively at inner edge portions on both sides constructing the first opening portion 58. These first guide projections 62 play a role of guiding the card 5 in the width direction, when the card 5 is reciprocated while contacting side surfaces of the rectangular protruding portion 13 of the base 1 that is arranged within the first opening portion 58. Further, slits 63 are formed at both side portions of the portions in which the first guide projections 62 are provided. The slits 63 provide a buffering function when the first guide projections 62 come into contact with the side surfaces of the rectangular protruding portion 13, and absorbs an error in part accuracy and assembly accuracy. Further, second guide projections 64 protruding toward the lower side are provided at two positions respectively at inner edge portions on both sides constructing the first opening portion 58. While the card 5 is reciprocated, these second guide projections 64 come into contact with the guide protrusion portions 12 formed on the housing portion 10 of the base 1 at all times, thereby preventing displacement in a vertical direction.

The first collar portion 27 of the yoke 24 is positioned in the second opening portion 59. A beam portion 65 comparting the first opening portion 58 and the second opening portion 59 is formed in an arch shape protruding toward the upper side, and acts to avoid interference with the electromagnet block 2 while achieving downsizing.

The guide portion 60 corresponds to a region which is provided at the opposite side to the beam portion 65 of the second opening portion 59 and comparted by a pair of protruding portions 66 protruding to the inner side from edge portions on both sides of the second opening portion 59, and within which the upper end portion of the movable iron piece 3 is positioned. A gap formed between both the protruding portions 66 corresponds to a space for inserting a thickness gauge to be utilized in an assembling work. Further, a locking concave portion 34*a* to which the locking pawl 36*a* of the movable iron piece 3 is locked is formed in an edge portion on the opposite side to the protruding portions 66 constructing the guide portion 60.

The case 6 is formed in a box shape in which one surface is opened, as shown in FIG. 1, is fitted to an outer peripheral edge of the base 1, and covers internal components. A gas drainage hole 67 is formed on a ceiling surface of the case 6 and is sealed with a resin after evacuating the internal portion and charging an inert gas (the gas drainage hole 67 may also be used in an opened state).

(Assembling Method)

A description will be given on a method for assembling the electromagnetic relay according to one or more embodiments of the present invention.

First, the electromagnet block 2 is assembled in a separate step. In the assembly of the electromagnet block 2, the coil 23 is wound around the truck portion 26 of the spool 22, the coil terminals 30 are press fitted into the seat portions 29, and both end portions of the wound coil 23 are thereafter wound around the coil terminals 30. Further, the iron core 21 is inserted into the truck portion 26 from one end side of the spool 22, and one end portion of the iron core 21 is inserted through the through hole of the yoke 24 to be caulked and fixed. At this time, projections formed within the circular concave portion 28 of the spool 22 is crushed by the magnetic pole portion 25 of the iron core 21, and the magnetic pole portion 25 is positioned within the circular concave portion 28.

Subsequently, the electromagnet block 2 is mounted on the base 1. In the mounting of the electromagnet block 2, the electromagnet block 2 is inserted into the housing portion 10 while guiding both the side portions of the yoke 24 in the guide portions 11 of the base 1.

Further, the movable iron piece 3 to which the hinge spring 37 is attached is fitted to the mounted electromagnet block 2. In the fitting of the movable iron piece 3, the elastic locking portions 40 of the hinge spring 37 are inserted between the upper surface of the base 1 and the yoke 24, and the elastic locking portions 40 are locked to the locking concave portions 34 formed in the yoke 24. Those of ordinary skill in the art can clearly recognize the fact that the elastic locking portions 40 are locked to the locking concave portions 34, that is, the fitting of the movable iron piece 3 and the hinge spring 37 is finished, on the basis of returning of the shape after the elastic deformation when inserting the elastic locking portions 40. Accordingly, the movable iron piece 3 is rotatably supported on one end portion of the yoke 24.

Next, the movable contact piece 41, the first fixed contact piece 42, and the second fixed contact piece 43 are press fitted laterally in the press fitting receiving portions 14, 15, and 16 of the base 1 respectively. The movable contact piece 41 press fitted in the first press fitting receiving portion 14, with its first contact piece portion 45 protruding into the concave portion 19 from the side surface forming the concave portion 19, is positioned, at a predetermined distance, above the bottom surface 19*a* forming the concave portion 19. Further, a distance between the lower surface of the first contact piece portion 45 and the upper surface of the deformation preventing portion 20 is set to such a value that the upper surface of the deformation preventing portion 20 is positioned just before the first contact piece portion 45 being deformed and reaching a plastic region from an elastic region. Further, a boundary position between the first contact piece portion 45 and the bent portion 46 is positioned above the deformation preventing portion 20 formed on the bottom surface 19*a* of the concave portion 19. The bent portion 46 corresponds to a position which is hardened through press working and is small in elastic deformation amount. Accordingly, in the case where the first contact piece portion 45 is elastically deformed, the first contact piece portion 45 can be contacted with the deformation preventing portion 20 at its terminal end. Accordingly, dimensional control is easily carried out, and it is possible to accurately bring the deformation preventing portion 20 into contact at a position just before reaching the plastic region from the elastic region. In addition, the protruding portion 18*c* provided in the insulating wall 17 is provided in such a manner as to be brought into contact with the second contact piece portion 47 just before the second contact piece portion 47 is deformed to reach the plastic region from the elastic region. Accordingly, the plastic deformation of the second contact piece portion 47 is also prevented. According to one or more embodiments of the present invention, in a state where each of the contact pieces 41, 42, and 43 is press fitted in each of the press fitting receiving portions 14, 15, and 16, the movable contact point 50 comes into pressure contact with the first fixed contact point 57*a* and opposes the second fixed contact point 57*b* at a predetermined distance.

When the fitting of the contact pieces 41, 42, and 43 to the base 1 is finished, the card 5 is installed above the base 1. In the installation of the card 5, the upper end portion of the movable iron piece 3 is held in the guide portion 60, and the guide shaft portions 61 are positioned within the guide holes 52 of the movable contact piece 41. The rectangular protruding portion 13 of the base 1 is positioned within the first opening portion 58 of the card 5, and the first guide projections 62 are brought into contact with the side surfaces of the rectangular protruding portion 13. Further, the second guide projections 64 are brought into contact with the guide protruding portions 12 of the base 1. Accordingly, the card 5 can be reciprocated at the same position in the width direction and the vertical direction at all times, and the guide shaft portions 61 do not contact the inner edges of the guide holes 52.

Figure 13:
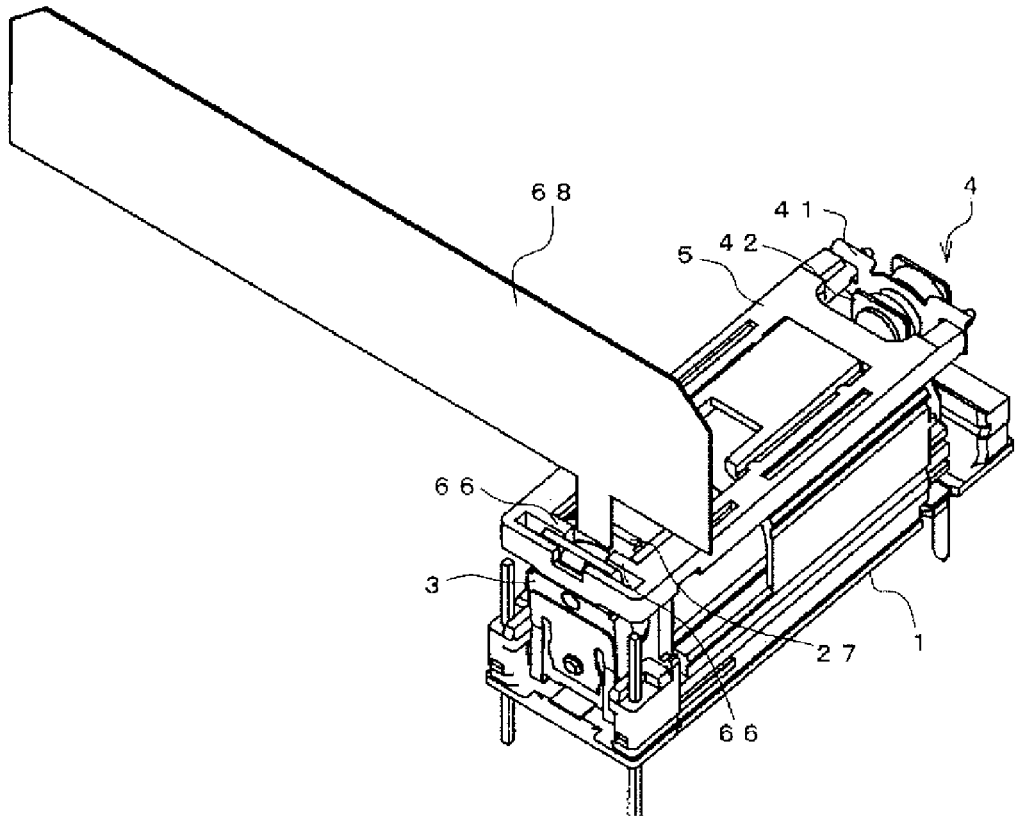
FIG. 13 shows a perspective view of an adjusting work utilizing a thickness gauge.

When all the parts except the case 6 are mounted on the base 1 in the manner described above, an adjusting work of a contact point contact pressure is carried out. According to one or more embodiments of the present invention, the adjusting work may be achieved by sequentially inserting the thickness gauges 68 having different thicknesses to the portion between the magnetic pole surface 25*a* of the iron core 21 and the magnetized pole surface of the movable iron piece 3, as shown in FIG. 13. In other words, in a state where the thickness gauge 68 is inserted, the electromagnet block 2 is excited, the movable iron piece 3 is rotated, the movable contact piece 41 is driven via the card 5, and the contact point is opened and closed. It is determined whether or not this operation is suitably carried out in a state where the thickness gauge 68 having a predetermined thickness is inserted. In the case where the operation is not carried out suitably, an intermediate position (the second contact piece portion 47) of the movable contact piece 41 is adjusted by bending manually.

The inserting position of the thickness gauges 68 exists in a space between the first collar portion 27 of the spool 22 positioned in the second opening portion 59 and the protruding portions 66 constructing the guide portion 60. The step portion 31 is formed in the first collar portion 27 of the spool 22, but the insertion preventing protruding portion 32 is provided thereon, whereby the thickness gauge 68 cannot be inserted to an erroneous position. Further, since the insertion preventing protruding portion 32 is provided with the inclined surface 32*a*, the thickness gauges 68 are smoothly guided between the movable iron piece 3 and the magnetic pole portion 25 of the iron core 21. Accordingly, it is possible to smoothly carry out the insertion of the thickness gauges 68 which have required a lot of skill, and it is possible to achieve an efficient adjusting work.

When the adjusting work of the contact point contact pressure is finished, the case 6 is put on the base 1, and a sealing agent seals the fitted portions between the both, and the terminal holes in which the terminals protrude from the lower surface of the base 1. At this time, the sealing agent enters the internal space. In the terminal hole with the terminal portion 44 of the movable contact piece 41 protruded therefrom, the sealing agent enters along the terminal portion 44 and reaches the concave portion 19, but the circular arc surface 14*a* is formed on a side surface of the first press fitting receiving portion 14 constructing the concave portion 19. Accordingly, it is possible to prevent the sealing agent from making further intrusion, and the sealing agent does not reach the deformation preventing portion 20 formed in the concave portion 19. Further, the sealing agent entering from the fitted portion of the base 1 with the case 6 reaches the concave portion 19 along the surface of the base 1. As described above, the deformation preventing portion 20 is formed in the inner side from the side edge portion of the base 1. Accordingly, the sealing agent entering from the fitted portion does not reach the deformation preventing portion 20. Therefore, it is possible to enable the deformation preventing portion 20 to fulfill an inherent function, that is, a function of preventing the plastic deformation of the movable contact piece 41 in the case where impact force is applied.

It is also assumed that the electromagnetic relay assembled as described above erroneously falls down during transportation or the like to be exposed to impact force. According to one or more embodiments of the present invention, the internal component, particularly the movable contact piece 41, is easily deformed elastically, and moreover, is structured such that a middle portion of the second contact piece portion 47 is bent and the movable contact point 50 is provided in the upper end portion. Accordingly, there is a possibility that the movable contact piece 41 is deformed beyond the elastic region. According to one or more embodiments of the present invention, the plastic deformation of the first contact piece portion 45 is prevented by the deformation preventing portion 20, and the plastic deformation of the second contact piece portion 47 is prevented by the protruding portion 18*c*. Further, since the guide shaft portions 61 of the card 5 are inserted to the guide holes 52 of the movable contact piece 41, it is possible to prevent the upper portion of the movable contact piece 41 from being deformed laterally. As described above, even in the case where impact force is applied to the internal components due to a fall or the like, it is possible to effectively prevent the plastic deformation of the movable contact piece 41 which tends to be most affected by the impact force. In other words, it is possible to provide an electromagnetic relay which is excellent in the impact resistance.

(Operation)

Next, a description will be given on an operation of the electromagnetic relay according to one or more embodiments of the present invention.

In an initial state, the electromagnet block 2 is demagnetized, and the movable iron piece 3 exists at a position which is away from the magnetic pole portion 25 of the iron core 21 by the energizing force of the hinge spring 37, and the energizing force of the movable contact piece 41 applied through the card 5. Accordingly, the movable contact piece 41 closes the movable contact point 50 to the first fixed contact point 57*a* of the first fixed contact piece 42, on the basis of its own spring force, and the energizing force of the hinge spring 37 applied through the card 5.

According to one or more embodiments of the present invention, when a current is applied to the coil 23 through the coil terminals 30 so as to excite the electromagnet block 2, the movable iron piece 3 is attracted to the magnetic pole portion 25 of the iron core 21 so as to rotate. Accordingly, the card 5 is moved. Since the card 5 is moved while the guide projections 62 and 64 are guided by the guide protruding portions 12 and the rectangular protruding portion 13 of the base 1, the card 5 is not displaced. Therefore, the guide shaft portions 61 of the card 5 do not come into contact with the inner edges of the guide holes 52 of the movable contact piece 41, and there is no risk that the resin powder is generated.

The pressure receiving portions 54 of the movable contact piece 41 is pressed by the pressing portions 5*a* due to the movement of the card 5. Accordingly, the movable contact piece 41 is elastically deformed so as to be driven, and closes the movable contact point 50 to the second fixed contact point 57 of the second fixed contact piece 43. According to one or more embodiments of the present invention, the positions of the pressure receiving portions 54 pressed by the pressing portions 5*a* correspond to positions at the opposite side to the movable contact point 50 with respect to the guide holes 52. Further, the guide shaft portions 61 are positioned within the guide holes 52. Accordingly, if the resin powder is generated from the pressing portions 5*a* when pressing the pressure receiving portions 54 by the pressing portions 5*a*, the resin powder is generated at the position which is remotest from the contact point opening and closing position, and the guide shaft portions 61 are interposed therebetween. Accordingly, the resin powder is not attached to the contact point. Therefore, it is possible to carry out a good contact point opening and closing operation for a long term.

Further, as the number of the contact point opening and closing operations increases, the carbon is generated, flies in all directions around the contact point opening and closing position, and is attached to the surface of the base 1 or the like. However, a plurality of protruding portions 18*a*, 18*b* and 18*c* is formed in the base 1 to form regions (non-attached regions) to which the flying carbon cannot be attached. Accordingly, it is possible to securely prevent a problem that the contact pieces 41, 42, and 43 short by the attached carbon, and it is possible to use the electromagnetic relay in a suitable state for a long term.

According to one or more embodiments of the present invention, although not apparent from the drawings, the actual size of the electromagnetic relay is very compact and may be 12 mm×28 mm×10 mm in length×width×height. Accordingly, a slight structural difference from the conventional electromagnetic relay greatly influences its performance.

What is claimed is:

1. An electromagnetic relay structured such that a base includes a movable contact piece and a fixed contact piece, and a movable contact point included in the movable contact piece is connected to and disconnected from a fixed contact point included in the fixed contact piece by operating the movable contact piece via a card, wherein at least any one of the base and the card includes a guide portion for guiding the card in a freely reciprocating manner with respect to the base, and the card includes:

a guide shaft portion; and a pressing portion for pressing the movable contact piece to elastically deform the movable contact piece, the movable contact piece including a extended portion in a side portion of the movable contact point, the extended portion including:

a guide hole into which the guide shaft portion is inserted, the guide hole maintaining a non-contact state of the guide shaft portion during the reciprocating motion;

a pressure receiving portion positioned only at an opposite side to the movable contact point with respect to the guide hole and pressed by the pressing portion; and a reinforcing portion for preventing plastic deformation at a time of being pressed by the pressing portion.

2. The electromagnetic relay according to claim 1, wherein the movable contact point is caulked and fixed on the movable contact piece, and the reinforcing portion is formed in an edge portion at a position remotest from the base up to at least the caulked and fixed position in the extended portion.

3. The electromagnetic relay according to claim 1, wherein the pressing portion of the card is formed in such a manner as to bulge gradually toward a center, and the position for pressing the pressure receiving portion of the movable contact piece is on an opposite side to the movable contact point with respect to the guide shaft portion.

4. The electromagnetic relay according to claim 2, wherein the pressing portion of the card is formed in such a manner as to bulge gradually toward a center, and the position for pressing the pressure receiving portion of the movable contact piece is on an opposite side to the movable contact point with respect to the guide shaft portion.

5. An electromagnetic relay structured such that a base includes a movable contact piece and a fixed contact piece, and a movable contact point included in the movable contact piece is connected to and disconnected from a fixed contact point included in the fixed contact piece by operating the movable contact piece via a card, wherein at least any one of the base and the card includes a guide portion for guiding the card in a freely reciprocating manner with respect to the base, and the card includes:

two guide shaft portions; and two pressing portions for pressing the movable contact piece to elastically deform the movable contact piece, the movable contact piece including two extended portions, each of which is formed in each of two side portions of the movable contact point, the guide each of the two extended portion including:

a guide hole into which the guide shaft portion is inserted, the guide hole maintaining a non-contact state of the guide shaft portion during the reciprocating motion;

two pressure receiving portions, each of which is positioned at an opposite side to the movable contact point with respect to each of the guide holes and pressed by each of the pressing portions, respectively; and a reinforcing portion for preventing plastic deformation at a time of being pressed by the pressing portion.

* * * * *